US011064788B2

(12) United States Patent
Lee

(10) Patent No.: US 11,064,788 B2
(45) Date of Patent: Jul. 20, 2021

(54) AUTOMATICALLY OPENED/CLOSED SEALING MODULE AND COSMETIC CASE EMPLOYING SEALING MODULE

(71) Applicant: PAIRGREEN INC., Yongin-shi (KR)

(72) Inventor: Hee Jeong Lee, Incheon (KR)

(73) Assignee: PAIRGREEN INC., Yongin-shi (KR)

( * ) Notice: Subject to any disclaimer, the term of this patent is extended or adjusted under 35 U.S.C. 154(b) by 14 days.

(21) Appl. No.: 16/603,194

(22) PCT Filed: Mar. 30, 2018

(86) PCT No.: PCT/KR2018/003805
§ 371 (c)(1),
(2) Date: Oct. 4, 2019

(87) PCT Pub. No.: WO2018/186630
PCT Pub. Date: Oct. 11, 2018

(65) Prior Publication Data

US 2020/0113310 A1 Apr. 16, 2020

(30) Foreign Application Priority Data

Apr. 7, 2017 (KR) ..... 10-2017-0045218

(51) Int. Cl.
*A45D 40/06* (2006.01)
*A45D 40/00* (2006.01)

(52) U.S. Cl.
CPC .... *A45D 40/065* (2013.01); *A45D 2040/0025* (2013.01); *A45D 2200/051* (2013.01)

(58) Field of Classification Search
CPC .... A45D 40/023; A45D 40/04; A45D 40/065; A45D 2040/0025; A45D 2200/051; B65D 53/02; B65D 83/0005
See application file for complete search history.

(56) References Cited

U.S. PATENT DOCUMENTS 2,089,832 A * 8/1937 Kasdan ..... A45D 40/065 401/59
2,128,515 A * 8/1938 Fouinat ..... A45D 40/023 401/59

(Continued)

FOREIGN PATENT DOCUMENTS

JP H 10-502860 A 3/1998
JP 2011-005000 A 1/2011

(Continued)

OTHER PUBLICATIONS

International Search Report, dated Jun. 26, 2018 for corresponding International Application No. PCT/KR2018/003805 with English translation.

(Continued)

*Primary Examiner* — J C Jacyna
(74) *Attorney, Agent, or Firm* — Intellectual Property Law Group LLP

(57) ABSTRACT

An object of the present invention is to provide a cosmetic case capable of automatically opening and closing a cover which is automatically opened and closed before extraction and retraction of a rod-shaped body such as a lipstick, thereby enhancing a convenience in use. To achieve the above object, the present invention provides an automatically opened/closed sealing module, including: a cylindrical exterior case having a hollow interior; a cylinder housed in the exterior case so that a portion thereof is extracted out and retracted into together with a rod-shaped body; and a shutter member configured to be automatically opened and closed to allow extraction and retraction of the rod-shaped body, wherein the shutter member includes: a link body including a link hook; a cap body formed at a position opposite to the link body and including a cap hook; shutter ledges formed on outer circumferential surfaces of the link body and the cap body with a difference in level to limit a movement of (Continued)

the link body; an inner slit ledge formed in one end of a slit section which is formed by facing the link body and the cap body toward each other, so as to be supported by the cylinder; and a cover rotatably formed through hinge parts integrally connected with the link body and the cap body.

9 Claims, 3 Drawing Sheets

(56) References Cited

U.S. PATENT DOCUMENTS 2,617,522 A * 11/1952 Coe ..... A45D 40/023 401/59
5,171,096 A * 12/1992 Perrotti ..... A45D 40/065 401/59
8,096,721 B2 * 1/2012 Carroll ..... A45D 40/12 401/59
2009/0188513 A1 * 7/2009 Delbove ..... A45D 40/12 132/200
2009/0245922 A1 * 10/2009 Armstrong ..... A45D 40/023 401/172
2016/0160967 A1 * 6/2016 Shin ..... A45D 40/023 74/103

FOREIGN PATENT DOCUMENTS

JP 2016-106863 A 1/2011
KR 20-0255135 Y1 12/2001
KR 20-0416531 Y1 5/2006
KR 10-2007-0027889 A 3/2007

OTHER PUBLICATIONS

Written Opinion of the ISA, dated Jun. 26, 2018 for corresponding International Application No. PCT/KR2018/003805.

* cited by examiner

AUTOMATICALLY OPENED/CLOSED SEALING MODULE AND COSMETIC CASE EMPLOYING SEALING MODULE

CROSS-REFERENCE TO RELATED APPLICATIONS

This application is a U.S. National Phase application, under 35 U.S.C. § 371, of International Application no. PCT/KR2018/003805, with an international filing date of Mar. 30, 2018, and claims priority to Korean application no. 10-2017-0045218, filed on Apr. 7, 2017, each of which is hereby incorporated by reference for all purposes.

TECHNICAL FIELD

The present invention relates to an automatically opened/closed sealing module and a cosmetic case employing the sealing module, and more particularly, to an automatically opened/closed sealing module which is automatically opened and closed so that a cover may be automatically opened and closed before extracting and retracting operations of a rod-shaped body such as a lipstick, and a cosmetic case employing the sealing module.

BACKGROUND ART

In general, a lipstick is a kind of cosmetics applied to give color and texture to lips, and uses pigments, oils, waxes, and softeners as a raw material. Such lipsticks are classified into a solid stick type lipstick, a liquid and cream type lip gloss, a cream type lip cream and the like.

Meanwhile, the stick type lipstick is fixed to a lipstick case to be used. Depending on a method of fixing a molded content of the lipstick, such lipstick cases may be classified into a front insert type lipstick case of inserting and fixing the content from above, a front filling type lipstick case of cooling the molten content after injecting it from the above, and a back filling type lipstick case of cooling the molten content after injecting it from below.

The lipstick case differs in an appearance depending on a method of injecting the content of lipstick, but methods using such a lipstick case are almost the same as each other.

The most common example of such a lipstick case is shown in FIG. 1. FIG. 1 is a perspective view schematically illustrating a lipstick case of the prior art.

Referring to FIG. 1, the lipstick case of the prior art includes a case body 1 and a lipstick protective tube 2 rotatably installed in the case body 1.

A lipstick holder 3 is located inside the lipstick protective tube 2 to be linearly moved up and down in the lipstick protective tube 2. A lipstick 4 for giving color and texture to lips is placed in the lipstick holder 3. A cap 5 may be located on the case body 1 to completely cover the lipstick protective tube 2, thereby preventing the lipstick 4 from being contaminated due to foreign matters.

When the lipstick holder 3 is linearly moved up and down in the protective tube 2 by a rotational movement of the lipstick protective tube 2, the lipstick 4 is extracted out and retracted into the case body 1.

However, if the cap 5 is lost, the lipstick 4 is exposed to an outside, such that there is a problem that the lipstick cannot be used due to the contamination.

As another example of the prior art, Korean Utility Model Registration No. 20-0416531 discloses a lipstick container which is configured to use a rod-shaped lipstick by extracting and retracting through the rotation thereof. More specifically, the lipstick container includes an automatic opening and closing means in which an upper end of the container having the rod-shaped lipstick coupled therewith is automatically opened and closed at the same time as the extraction and retraction of the lipstick. The lipstick container includes: a decorative container divided into upper and lower portions by a decorative strip, and having first and second guide rails formed on upper and lower portions of an inner surface thereof; an outer container rotatably coupled to the lower portion of the decorative container; an inner container housed inside the decorative container, fixedly coupled to the outer container through the lower end thereof so as to be simultaneously rotated therewith, and having a third guide rail formed on the upper portion and a fourth guide rail formed on the lower portion thereof; a piston housed in the inner container with the rod-shaped lipstick being fitted thereto, and having first guide protrusions formed on both symmetrical sides thereof; a vertical operation container coupled between the decorative container and the inner container, wherein an over cap for opening and closing the upper end of the inner container is coupled to hinge axes on both sides of the upper end thereof, a fifth guide rail is formed below the hinge axes, a second guide protrusion protrudes from a lower inner surface of the fifth guide rail, and a third guide protrusion protrudes from a lower outer surface thereof; and an outer cap fixedly coupled to the upper portion of the decorative container, wherein an upper end thereof hermetically covers an outer circumferential surface of the over cap, and an entrance for extracting and retracting the lipstick coupled to the piston is formed at a center thereof.

However, the lipstick container has a complicated structure and an inconvenience in the operation thereof.

PRIOR ART DOCUMENT

Patent Document (Patent Document 1) Korean Utility Model Registration No. 20-0416531 (published on May 16, 2006)

(Patent Document 2) Korean Utility Model Registration No. 20-0255135 (published on Dec. 13, 2001)

SUMMARY OF THE INVENTION

Problems to be Solved by Invention

In consideration of the above-mentioned circumstances, it is an object of the present invention to provide an automatically opened/closed sealing module which is automatically opened and closed so that a cover may be automatically opened and closed before extraction and retraction of a rod-shaped body such as a lipstick, thereby improving convenience in use, and a cosmetic case employing the sealing module.

Another object of the present invention is to provide an automatically opened/closed sealing module capable of preventing an interference during extraction and retraction of a rod-shaped body through a cover that is automatically opened and closed, and preventing a lipstick from being contaminated, and a cosmetic case employing the sealing module.

Means for Solving Problems

In order to achieve the above object, according to an aspect of the present invention, there is provided an automatically opened/closed sealing module, including: a cylindrical exterior case having a hollow interior; a cylinder housed in the exterior case so that a portion thereof is extracted out and retracted into together with a rod-shaped body; and a shutter member configured to be automatically opened and closed to allow extraction and retraction of the rod-shaped body, wherein the shutter member includes: a link body including a link hook; a cap body formed at a position opposite to the link body and including a cap hook; shutter ledges formed on outer circumferential surfaces of the link body and the cap body with a difference in level to limit a movement of the link body; an inner slit ledge formed in one end of a slit section which is formed by facing the link body and the cap body toward each other, so as to be supported by the cylinder; and a cover rotatably formed through hinge parts integrally connected with the link body and the cap body.

According to an embodiment of the present invention, an O-ring may be further installed on a rear end side of the shutter member.

According to an embodiment of the present invention, a packing may be further installed in the cover of the shutter member.

According to an embodiment of the present invention, a cosmetic case may include a portion of the cylinder forming the sealing module therein, and may further include a cylindrical main body having a hollow interior so as to be coupled to the exterior case; a rotational body installed in the main body, and having a thread section formed thereon to help an advancement of the rod-shaped body at the time of rotational operation; and a piston installed outside of the thread section, and configured to guide the rotating rotational body to move linearly by the rotational operation of the rotational body, wherein the rod-shaped body is located at a tip end of the piston.

According to an embodiment of the present invention, the main body may include a pair of slit protrusions formed at one end thereof to face each other, so as to be laterally shifted due to an elastic force applied thereto; and guide protrusions formed on slit sections of the slit protrusions; the exterior case may include step guide grooves formed in the inner circumferential surface in a longitudinal direction thereof so as to be moved together with the guide protrusions by shifting due to the elastic force applied thereto when rotating the slit protrusions from an initially located state; and an inner annular step may be formed at an inner central portion of the exterior case where the step guide groove ends.

According to an embodiment of the present invention, the thread section may be formed on a portion of an outer circumferential surface of the rotational body, and a knurled rotation knob may be formed on an end side thereof.

According to an embodiment of the present invention, one end of the piston may be closed to allow the rod-shaped body to abut; a pair of piston slit groove sections may be formed on an outer circumferential surface of the piston along a longitudinal direction thereof; an annular thread section may be formed on an inner circumferential surface of the piston so as to be screwed with the thread section of the rotational body; and the cylinder may include cylinder guide protrusions which are formed on a cylindrical inner circumferential surface thereof, and are configured to be inserted into the piston slit groove sections so as to guide the piston to linearly move by the rotational operation of the rotational body; a pair of cylinder protrusions formed on an outer circumferential surface thereof so as to help a return of the shutter member; and cylinder groove sections formed to face each other at positions different from each other near the cylinder protrusions to help a movement of the shutter member.

Advantageous Effects

In accordance with the automatically opened/closed sealing module and the cosmetic case employing the sealing module according to the present invention, the cover is automatically opened and closed before extraction and retraction of the rod-shaped body such as a lipstick, thereby enhancing the convenience in use and improving stability.

In addition, it is possible to prevent an interference during extraction and retraction of the rod-shaped body through the cover that is automatically opened and closed, and prevent the lipstick from being contaminated, such that there are effects of improving the stability and reliability of a cosmetic product.

DETAILED DESCRIPTION OF SPECIFIC EMBODIMENTS

Mode for Carrying Out Invention

Hereinafter, exemplary embodiments of the present invention will be described in detail. The following embodiments are described in order to enable those of ordinary skill in the art to embody and practice the present invention. However, the present invention is not limited to the embodiments disclosed below, but can be implemented in various forms. To aid in understanding the present invention, like numbers refer to like elements throughout the description of the drawings, and the description of the same elements will not be described.

In the specification of the present invention, when the explanatory phrase a part "includes" a component is used, this means that the part may further include the component without excluding other components, so long as special explanation is not given.

Figure 1:
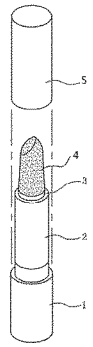
FIG. 1 is a view illustrating a conventional lipstick case.
Figure 2:
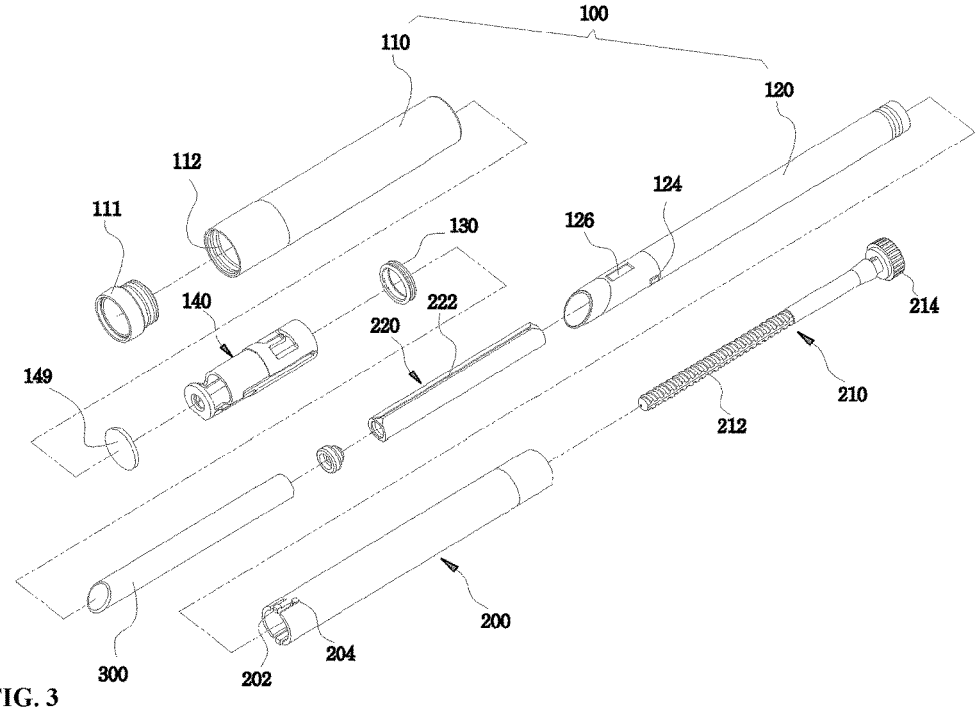
FIG. 2 is an exploded perspective view of a cosmetic case according to the present invention.
Figure 3:
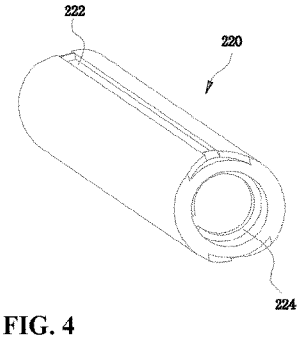
FIG. 3 is a perspective view illustrating an inside of a piston according to the present invention.
Figure 4:
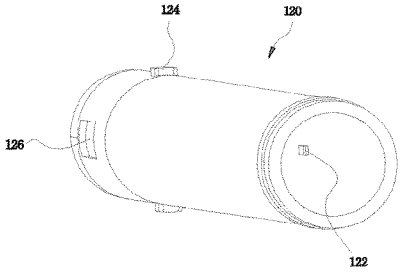
FIG. 4 is a perspective view illustrating an inside of a cylinder according to the present invention.
Figure 5:
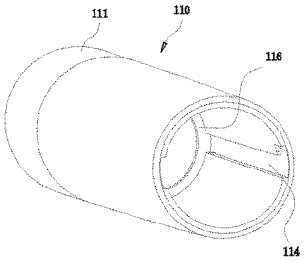
FIG. 5 is a perspective view illustrating an inside of an exterior case according to the present invention.
Figure 6:
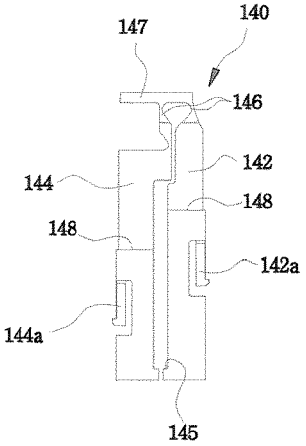
FIG. 6 is a front view illustrating a shutter member according to the present invention.
Figure 7:
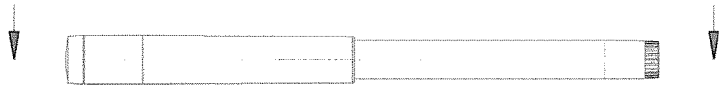
FIGS. 7 and 8 are a front view and a cross-sectional view illustrating a closed state of the cosmetic case according to the present invention, respectively.
Figure 8:
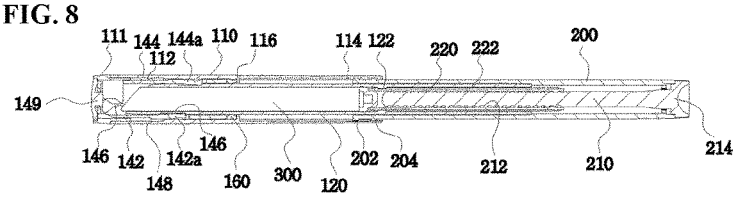
Figure 9:
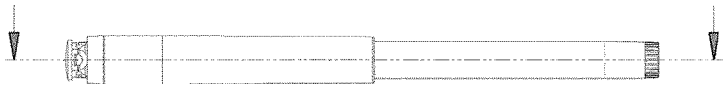
FIGS. 9 and 10 are a side view and a cross-sectional view illustrating operation step 1 of the cosmetic case according to the present invention, respectively.
Figure 10:
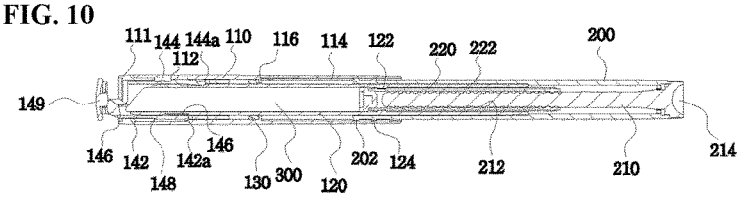
Figure 11:
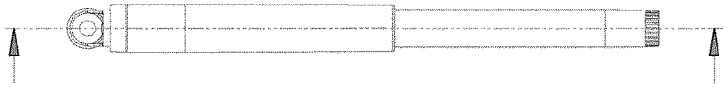
FIGS. 11 and 12 are a side view and a cross-sectional view illustrating operation step 2 of the cosmetic case according to the present invention, respectively.
Figure 12:
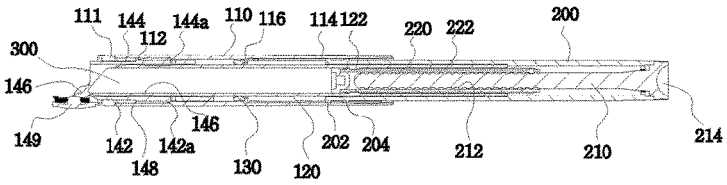
Figure 13:
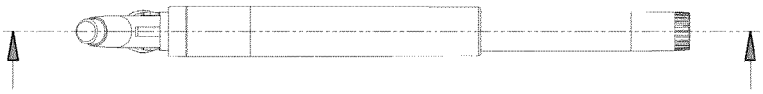
FIGS. 13 and 14 are a side view and a cross-sectional view illustrating operation step 3 of the cosmetic case according to the present invention, respectively.
Figure 14:
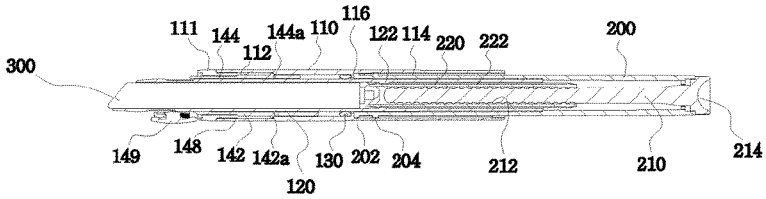
Figure 15:
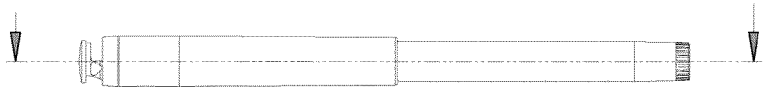
FIGS. 15 and 16 are a side view and a cross-sectional view for explaining a closing operation after a cover of the cosmetic case according to the present invention is opened, respectively.
Figure 16:
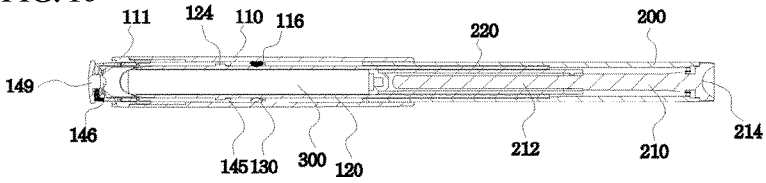

Herein, FIG. 2 is an exploded perspective view of a cosmetic case according to the present invention, FIG. 3 is a perspective view illustrating an inside of a piston according to the present invention, FIG. 4 is a perspective view illustrating an inside of a cylinder according to the present invention, FIG. 5 is a perspective view illustrating an inside of an exterior case according to the present invention, FIG. 6 is a front view illustrating a shutter member according to the present invention, FIGS. 7 and 8 are a front view and a cross-sectional view illustrating a closed state of the cosmetic case according to the present invention, respectively, FIGS. 9 and 10 are a side view and a cross-sectional view illustrating operation step 1 of the cosmetic case according to the present invention, respectively, FIGS. 11 and 12 are a side view and a cross-sectional view illustrating operation step 2 of the cosmetic case according to the present invention, respectively, FIGS. 13 and 14 are a side view and a cross-sectional view illustrating operation step 3 of the cosmetic case according to the present invention, respectively, FIGS. 15 and 16 are a side view and a cross-sectional view for explaining a closing operation after a cover of the cosmetic case according to the present invention is opened, respectively.

As shown in FIG. 2, a cosmetic case capable of automatically opening and closing a cover according to the present invention generally includes a sealing module 100 including an exterior case 110, a cylinder 120, a shutter member 140, and an O-ring 130. A cosmetic case to which the sealing module 100 is applied and operated in connection therewith may include a cylindrical main body 200, a rotational body 210 installed inside the main body 200, and a piston 220 installed outside the rotational body 210.

Herein, the cosmetic case is a long rod-shaped case for containing a content such as a lipstick, lip balm, lip gloss, tint, ink cartridge, and the like, and types thereof are not limited to any one case. As one example, a rod-shaped body 300 may be any type of lipstick.

First, the cosmetic case will be described with reference to FIG. 2. For the convenience of explanation, the main body 200, the rotational body 210, and the piston 220 forming the cosmetic case, as well as the sealing module 100 will be described according to an assembling order or operational relationship in connection therewith. As shown in FIG. 2, the main body 200 may be manufactured by injection molding or extrusion molding using a synthetic resin material or a metal material, and may have a hollow tube shape or a cylindrical tube shape.

The main body 200 may include a pair of slit protrusions 202 formed at one end thereof to face each other, and slits formed with a predetermined length on both sides of the slit protrusion 202. Thereby, the slit protrusion 202 may be laterally shifted due to an elastic force applied thereto during a forced rotational operation through slit spaces on both sides thereof.

In addition, a guide protrusion 204 may be formed at an end point of any one of the slits around the slit protrusion 202, which protrudes from a surface of the main body with a predetermined height.

The slit protrusion 202 and the guide protrusion 204 protrude to the same height as each other, and the slit protrusion 202 may be aligned in line with the guide protrusion 204 at the time of an elastic movement thereof.

Next, the exterior case 110 of the sealing module 100 forming the outer main body together with the main body 200 will be described first with reference to FIG. 5.

The exterior case 110 may also be manufactured by injection molding or extrusion molding using a synthetic resin material or a metal material, and may have a hollow tube shape or a cylindrical tube shape. In this case, the exterior case may have an outer diameter larger than that of the main body 200, and may include an outer mount 111 that can be coupled in a screwing or tight fitting manner so as to improve an assemblability at the front end and limit a movement of the shutter member 140.

Herein, an inner step (112 of FIG. 2) may be formed in an inner circumferential surface of the exterior case 110 with a predetermined depth, with which the outer mount 111 is fastened.

In addition, step guide grooves 114 may be formed in the inner circumferential surface of the exterior case 110 in a longitudinal direction thereof so as to be moved together with the guide protrusions 204 by shifting due to the elastic force applied thereto when rotating the slit protrusions 202 from an initially located state.

The step guide groove 114 is formed in a substantially L shape, and the slit protrusion 202 is located at a bent portion thereof. When forcibly rotating the main body from a state of blocking the rotation, the slit protrusion 202 may be elastically bent and aligned in line with the guide protrusion 204, thus to be moved in the longitudinal direction.

In addition, an inner annular step 116 may be formed at an inner central portion of the exterior case 110 where the step guide groove 114 ends, which protrudes from the inner circumferential surface to a predetermined height.

The O-ring 130 may be located on the inner annular step 116 to be described below.

Again referring to FIG. 2, the O-ring 130 is a means for maintaining airtightness with the main body 200, and is made of any one of rubber, silicone, soft plastic used in a conventional watertight or airtight means, thereby having an excellent sealing force due to elastomeric properties that maintain its original shape by a high surface tension against a non-compressible fluid body with a high rigidity.

In addition, the rotational body 210 substantially helps an advancement of the rod-shaped body 300 by the rotational operation thereof, and may be made of a synthetic resin material or a metal material.

As shown in FIG. 2, rotational body 210 has a length corresponding to two thirds of an entire length of the cosmetic case. The rotational body 210 may include a thread section 212 formed on a portion of an outer circumferential surface thereof, and a knurled rotation knob 214 formed at one end thereof to prevent slipping.

Preferably, the thread section 212 is formed across one half of the entire length of the rotational body, may be continuously formed along a circumferential direction, and may have a shape whose both ends are cut in a vertical plane.

Further, although not shown in the drawings, protrusions may be formed on the rotation knob 214 to allow one-way rotation thereof.

In addition, as shown in FIG. 3, the piston 220 is installed outside of the thread section 212, and serves to guide the rotating rotational body 210 so as to move linearly. The piston may also be manufactured by injection molding or extrusion molding using a synthetic resin material or a metal material.

The piston 220 having a form of a hollow tube is closed at one end. At this time, since it is difficult to integrally form a closed end with the piston due to a structure of a mold, a separate cap 151 is inserted into one end of the piston in a tight fitting manner to close the one end. The rod-shaped body 300 may abut on and be supported by one side of the cap.

Further, a pair of piston slit groove sections 222 are formed in the outer circumferential surface of the piston along the longitudinal direction.

Herein, the cylinder guide protrusions 122 of the cylinder 120 to be described below are inserted into the piston slit groove sections 222, thereby allowing the piston to linearly move at the time of the rotational operation of the rotational body.

In addition, an annular thread 224 may be formed on the inner circumferential surface near an opening formed at the other end of the piston 220 so as to be screwed with the thread section 212 of the rotational body 210.

The cylinder 120 will be described with reference to FIG. 4. As shown in FIG. 4, the cylinder is installed outside of the piston 220, and is a component in which a portion thereof is extracted out and retracted into the case together with the rod-shaped body 300.

The cylinder may also be manufactured by injection molding or extrusion molding using a synthetic resin material or a metal material, and similarly to the piston 220, the rod-shaped body 300 is disposed therein. The rod-shaped body may protrude outwardly from the cylinder 120 by a predetermined length depending on a degree of rotational operation of the rotational body 210.

The cylinder includes: the cylinder guide protrusions 122 formed on the inner circumferential surface thereof in the longitudinal direction so as to allow the piston to linearly move with being inserted into the piston slit groove sections 222 by the rotational operation of the thread section 212 of the rotational body 210; and a pair of cylinder protrusions 124 formed on the outer circumferential surface thereof so as to help a return of the shutter member 140. Further, cylinder groove sections 126 are formed to face each other at positions different from each other near the cylinder protrusions 124 in the direction orthogonal to the cylinder protrusions to help a movement of the shutter member 140.

Herein, any one of the two cylinder groove sections 126 may be located at a front end into which the piston 220 is inserted, and the other one may be located at a lower level than the one cylinder groove section so as to be arranged in a diagonal direction and not positions opposite to each other.

As shown in FIGS. 2 to 6, the shutter member 140 is automatically opened and closed to allow the extraction and retraction of the rod-shaped body 300, and may include: a cap body 142 and a link body 144; and a cover 147 hinged to the cap body 142 and the link body 144.

A link hook 144*a* may be formed at a predetermined position on the link body 144, and a cap hook 142*a* may be formed at a position opposite to the link body 144 in a shape similar to the link hook.

Herein, the cap hook 142*a* is formed at a relatively higher level than the link hook 144*a*, and shutter ledges 148 are formed on the outer circumferential surface of the link body 144 and the cap body 142 at equal distances away from each of the link hook 144*a* and the cap hook 142*a* with a difference in level. The shutter ledges 148 serve to limit the movement of the link body 144.

In addition, a slit section, which is a space, is formed along the longitudinal direction in a state in which the link body 144 and cap body 142 face each other, and an inner slit ledge 145 is formed in one end of the slit section, such that the cylinder protrusions 124 of the cylinder 120 may be supported in a manner of limiting the movement thereof.

Further, the cover 147 is rotatably formed through hinge parts 146 integrally connected with the link body 144 and the cap body 142. The cover 147 is operated in such a manner that it moves in the longitudinal direction and then is opened while being bent back through the hinge parts 146.

In addition, a packing 149 of rubber material or synthetic resin material may be further installed to the cover 147 for protection it from an external impact.

The packing 149 may be formed in the same area as or slightly larger area than the cover 147, and may be installed in the cover 147 in tight fitting manner through a protrusion or the like.

Operations of the stick-type cosmetic case capable of automatically opening and closing the cover having the above-described configuration according to the present invention will be described with reference to FIGS. 7 to 16.

FIGS. 7 and 8 illustrate a case in which the cosmetic case may be carried or safely stored in a closed state.

Referring to FIGS. 9 and 10, as an initial operation, first, when a user rotates the main body 200 in one direction, the slit protrusion 202 bends in the one direction and is aligned in line with the guide protrusion 204, such that it is ready to lead into the step guide groove 114 of the exterior case 110.

Subsequently, when pushing the main body 200 and the exterior case 110 in a direction facing each other, the slit protrusion 202 and the guide protrusion 204 aligned in line with each other are moved along the step guide groove 114, such that a portion of each of the cylinder 120, the rod-shaped body 300 and the shutter member 140 located inside the exterior case 110 is exposed to an outside.

In this state, as shown in FIGS. 11 and 12, when further pushing the exterior case 110 and the main body 200 in the direction facing each other, the shutter member 140 and the cap hook 142*a* of the cap body 142 interfere with each other and are positioned in the cylinder groove sections 126 of the cylinder 120 while being pressed. Then, the cap hook 142*a* is separated from the cylinder groove section 126 and is positioned on the inner step 112 side of the exterior case 110, and at the same time, the shutter ledge 148 on the cap body 142 side contacts the end side of the outer mount 111, such that further movement is blocked. The link body 144 is moved by the subsequent continuous pushing action to open the cover 147 connected thereto by the hinge part 146.

Thereafter, referring to FIGS. 13 and 14, a movement of the shutter ledge 148 on the link body 144 side is also blocked by the outer mount 111 with the cover 147 being opened. In this state, the slit protrusion 202 and the guide protrusion 204 continue to move along the step guide groove 114, and the movement thereof is blocked by the inner annular step 116 of the exterior case 110 to stop the main body. In this state, a portion of the rod-shaped body 300 which has been located in the cylinder 120 and at a tip end of the piston 220 protrudes in the longitudinal direction.

An advancing length of the rod-shaped body 300 protruding from the cylinder 120 may be adjusted. When rotating the rotation knob 214 of the rotational body 210 in one direction while being grasped by the user, the rotational operation of the knob is continued to a linear movement by the cylinder guide protrusion 122 of the cylinder 120 inserted into the piston slit groove section 222 of the piston 220, thereby pushing the piston 220 to advance the rod-shaped body 300.

Meanwhile, an operation of closing the cover 147 is performed in reverse order of the advancement operation. As shown in FIGS. 15 and 16, the main body 200 and the exterior case 110 are pulled away from each other by the user. In this process, while the shutter member 140 moves, the inner slit ledge 145 contacts and is supported by the cylinder protrusion 124 of the cylinder 120, and the exterior case 110 is moved. The movement of the exterior case may be triggered at a point in which an end of the shutter member 140 contacts the O-ring 130.

As described above, in accordance with the stick-type cosmetic case capable of automatically opening and closing the cover according to the embodiment of the present invention, the cover may be automatically opened and closed before extraction and retraction of the rod-shaped body such as a lipstick to enhance the convenience in use and improve the stability.

In addition, it is possible to prevent an interference during extraction and retraction of the rod-shaped body through the cover that is automatically opened and closed, and prevent the lipstick from being contaminated, such that there are effects of improving the stability and reliability of a cosmetic product.

While the present invention has been described with reference to the preferred embodiments, the present invention is not limited to the above-described specific embodiments, and it will be understood by those skilled in the art that various modifications and variations may be made without departing from the scope of the present invention as defined by the appended claims, as well as these modifications and variations should be included in the scope of the present invention.

DESCRIPTION OF REFERENCE NUMERALS

100: Sealing module 110: Exterior case
111: Outer mount 112: Inner step
114: Step guide groove 116: Inner annular step
120: Cylinder 122: Cylinder guide protrusion
124: Cylinder protrusion 126: Cylinder groove section
130: O-ring 140: Shutter member
142: Cap body 142*a*: Cap hook
144: Link body 144*a*: Link hook
145: Inner slit ledge 146: Hinge part
147: Cover 148: Shutter ledge
149: Packing 200: Main body
202: Slit protrusion 204: Guide protrusion
210: Rotational body 212: Thread section
214: Rotation knob 220: Piston
222: Piston slit groove section 224: Thread
300: Rod-shaped body
Sequence Text
None

The invention claimed is:

1. A cosmetic case employing an automatically opened/closed sealing module, comprising:
- a cylindrical exterior case having a hollow interior;
- a cylinder housed in the exterior case so that a portion thereof is extracted out and retracted into together with a rod-shaped body disposed inside the cylinder; and
- a shutter member configured to be automatically opened and closed to allow extraction and retraction of the rod-shaped body,
- wherein the shutter member comprises:
  - a link body including a link hook;
  - a cap body formed at a position opposite to the link body and including a cap hook;
  - shutter ledges formed on outer circumferential surfaces of the link body and the cap body with a difference in level to limit a movement of the link body;
  - an inner slit ledge formed in one end of a slit section which is formed by facing the link body and the cap body toward each other, so as to be supported by the cylinder; and
  - a cover rotatably formed through hinge parts integrally connected with the link body and the cap body;
- wherein the cosmetic case further comprises:
- a cylindrical main body having a hollow interior so as to be coupled to the exterior case;
- a rotational body installed in the main body, and having a thread section formed thereon to help an advancement of the rod-shaped body at the time of rotational operation; and
- a piston installed outside of the thread section, and configured to guide the rotating rotational body to move linearly by the rotational operation of the rotational body, wherein the rod-shaped body is located at a tip end of the piston;
- wherein the main body comprises a pair of slit protrusions formed at one end thereof to face each other, so as to be laterally shifted due to an elastic force applied thereto; and guide protrusions formed on slit sections of the slit protrusions,
- the exterior case comprises step guide grooves formed in an inner circumferential surface in a longitudinal direction thereof so as to be moved together with the guide protrusions by shifting due to the elastic force applied thereto when rotating the slit protrusions from an initially located state, and
- an inner annular step is formed at an inner central portion of the exterior case where the step guide groove ends.

2. The cosmetic case employing an automatically opened/closed sealing module according to claim 1, further comprising an O-ring installed on one end side of the shutter member.

3. The cosmetic case employing an automatically opened/closed sealing module according to claim 1, wherein a packing is further installed in the cover of the shutter member.

4. A cosmetic case employing an automatically opened/closed sealing module, comprising:
- a cylindrical exterior case having a hollow interior;
- a cylinder housed in the exterior case so that a portion thereof is extracted out and retracted into together with a rod-shaped body disposed inside the cylinder; and
- a shutter member configured to be automatically opened and closed to allow extraction and retraction of the rod-shaped body,
- wherein the shutter member comprises:
  - a link body including a link hook;
  - a cap body formed at a position opposite to the link body and including a cap hook;
  - shutter ledges formed on outer circumferential surfaces of the link body and the cap body with a difference in level to limit a movement of the link body;
  - an inner slit ledge formed in one end of a slit section which is formed by facing the link body and the cap body toward each other, so as to be supported by the cylinder; and
  - a cover rotatably formed through hinge parts integrally connected with the link body and the cap body;
- wherein the cosmetic case further comprises:
- a cylindrical main body having a hollow interior so as to be coupled to the exterior case;

a rotational body installed in the main body, and having a thread section formed thereon to help an advancement of the rod-shaped body at the time of rotational operation; and a piston installed outside of the thread section, and configured to guide the rotating rotational body to move linearly by the rotational operation of the rotational body, wherein the rod-shaped body is located at a tip end of the piston;

wherein the thread section is formed on a portion of an outer circumferential surface of the rotational body, and a knurled rotation knob is formed on an end side thereof.

5. A cosmetic case employing an automatically opened/closed sealing module, comprising:

a cylindrical exterior case having a hollow interior;

a cylinder housed in the exterior case so that a portion thereof is extracted out and retracted into together with a rod-shaped body disposed inside the cylinder; and a shutter member configured to be automatically opened and closed to allow extraction and retraction of the rod-shaped body, wherein the shutter member comprises:

a link body including a link hook;

a cap body formed at a position opposite to the link body and including a cap hook;

shutter ledges formed on outer circumferential surfaces of the link body and the cap body with a difference in level to limit a movement of the link body;

an inner slit ledge formed in one end of a slit section which is formed by facing the link body and the cap body toward each other, so as to be supported by the cylinder; and a cover rotatably formed through hinge parts integrally connected with the link body and the cap body;

wherein the cosmetic case further comprises:

a cylindrical main body having a hollow interior so as to be coupled to the exterior case;

a rotational body installed in the main body, and having a thread section formed thereon to help an advancement of the rod-shaped body at the time of rotational operation; and a piston installed outside of the thread section, and configured to guide the rotating rotational body to move linearly by the rotational operation of the rotational body, wherein the rod-shaped body is located at a tip end of the piston; wherein one end of the piston is closed to allow the rod-shaped body to abut, a pair of piston slit groove sections are formed on an outer circumferential surface of the piston along a longitudinal direction thereof, and an annular thread section is formed on an inner circumferential surface of the piston so as to be screwed with the thread section of the rotational body, and the cylinder comprises: cylinder guide protrusions which are formed on a cylindrical inner circumferential surface thereof, and are configured to be inserted into the piston slit groove sections so as to guide the piston to linearly move by the rotational operation of the rotational body;

a pair of cylinder protrusions formed on an outer circumferential surface thereof so as to help a return of the shutter member; and cylinder groove sections formed to face each other at positions different from each other near the cylinder protrusions to help a movement of the shutter member.

6. The cosmetic case employing a sealing module according to claim 4, further comprising an O-ring installed on one end side of the shutter member.

7. The cosmetic case employing a sealing module according to claim 4, wherein a packing is further installed in the cover of the shutter member.

8. The cosmetic case employing a module according to claim 5, further comprising an O-ring installed on one end side of the shutter member.

9. The cosmetic case employing a sealing module according to claim 5, wherein a packing is further installed in the cover of the shutter member.

* * * * *